US011232761B2

(12) United States Patent
Chen et al.

(10) Patent No.: US 11,232,761 B2
(45) Date of Patent: Jan. 25, 2022

(54) GHOST RELIEVING CIRCUIT FOR DISPLAY PANEL, DISPLAY PANEL AND GHOST RELIEVING METHOD FOR DISPLAY PANEL

(71) Applicant: Xianyang Caihong Optoelectronics Technology Co.,Ltd, Xianyang (CN)

(72) Inventors: Yuyeh Chen, Xianyang (CN); Yuan-Liang Wu, Xianyang (CN); Lei Sun, Xianyang (CN)

(73) Assignee: XIANYANG CAIHONG OPTOELECTRONICS TECHNOLOGY CO., LTD, Xianyang (CN)

( * ) Notice: Subject to any disclaimer, the term of this patent is extended or adjusted under 35 U.S.C. 154(b) by 0 days.

(21) Appl. No.: 16/990,115

(22) Filed: Aug. 11, 2020

(65) Prior Publication Data

US 2020/0372867 A1 Nov. 26, 2020

Related U.S. Application Data

(62) Division of application No. 16/396,823, filed on Apr. 29, 2019, now Pat. No. 10,984,739.

(30) Foreign Application Priority Data

Apr. 28, 2018 (CN) ..... 201810402268.6

(51) Int. Cl.
*G09G 3/36* (2006.01)
*G09G 3/20* (2006.01)

(52) U.S. Cl.
CPC ..... *G09G 3/3607* (2013.01); *G09G 3/2044* (2013.01); *G09G 3/3614* (2013.01); *G09G 3/3677* (2013.01); *G09G 3/3688* (2013.01); *G09G 2310/027* (2013.01); *G09G 2310/08* (2013.01); *G09G 2320/0257* (2013.01)

(58) Field of Classification Search
CPC .. G09G 3/3607; G09G 3/2044; G09G 3/3614; G09G 3/3677; G09G 3/3688; G09G 2310/027; G09G 2310/08; G09G 2320/0257
See application file for complete search history.

(56) References Cited

U.S. PATENT DOCUMENTS 6,011,533 A * 1/2000 Aoki ..... G09G 3/3611 345/92
2005/0110796 A1* 5/2005 Flowers ..... G09G 3/2025 345/589
2006/0164356 A1* 7/2006 Yang ..... G09G 3/3648 345/89
2007/0109313 A1* 5/2007 Jo ..... H04N 5/20 345/589
2007/0164941 A1* 7/2007 Park ..... G09G 3/3233 345/77

(Continued)

*Primary Examiner* — Ariel A Balaoing
(74) *Attorney, Agent, or Firm* — WPAT, PC

(57) ABSTRACT

The invention relates to a ghost relieving method for a display panel. The ghost relieving method for a display panel includes acquiring input gray scales; acquiring first gray scales and second gray scales according to the input gray scales; acquiring corresponding first voltages according to the first gray scales and corresponding second voltages according to the second gray scales; and outputting the first voltages and the second voltages to a pixel matrix.

10 Claims, 5 Drawing Sheets

(56) References Cited

U.S. PATENT DOCUMENTS

| | | | | |
|---|---|---|---|---|
| 2007/0229423 | A1* | 10/2007 | Tyrrell | G09G 3/3622 345/89 |
| 2012/0120124 | A1* | 5/2012 | Zhang | G09G 3/3648 345/690 |
| 2015/0161936 | A1* | 6/2015 | Jang | G09G 3/20 345/214 |
| 2015/0228055 | A1* | 8/2015 | Schutten | G09G 5/395 345/606 |
| 2016/0005370 | A1* | 1/2016 | Liu | G09G 3/3406 345/691 |
| 2017/0148369 | A1* | 5/2017 | Park | G09G 3/2007 |

* cited by examiner

N frame

N+1 frame

N+2 frame

GHOST RELIEVING CIRCUIT FOR DISPLAY PANEL, DISPLAY PANEL AND GHOST RELIEVING METHOD FOR DISPLAY PANEL

CROSS-REFERENCE TO RELATED APPLICATIONS

This application is a divisional application of U.S. patent application Ser. No. 16/396,823, filed on Apr. 29, 2019, which claims priority of Chinese Patent Application No. CN201810402268.6, filed on Apr. 28, 2018, the entire contents of which are incorporated herein by reference.

FIELD OF THE DISCLOSURE

The present invention relates to the field of display technologies, and in particular to a ghost relieving circuit for a display panel, a display panel and a ghost relieving method for a display panel.

BACKGROUND OF THE DISCLOSURE

With the development of display technology, liquid crystal display (LCD) has gradually replaced the cathode ray tube (CRT) display device due to its advantages of lightness, thinness and low radiation. Liquid crystal displays are widely used in information terminals such as computers, smart phones, mobile phones, car navigation devices, and electronic books, and become the most common display devices.

On the one hand, there is only one gamma chip on the liquid crystal display panel currently used. Please refer to FIG. 1, which is a schematic diagram of three areas in a liquid crystal display panel of the prior art. The entire liquid crystal display panel shares a common voltage Vcom, so that only the display effect of the area 2 on the display panel is optimal, and the related voltage characteristics of the area 1 and the area 3 on the display panel are different from those of the area 2, thereby causing the ghost problem.

On the other hand, the liquid crystal molecules in the liquid crystal display panel are fixed at a certain voltage for a long time, which causes the ions around the liquid crystal molecules to move toward the glass direction, and even some ions may adhere to the alignment film. When the voltage is applied, the electric field generated by the ions cancels a part, which causes the liquid crystal deflection characteristics to change. Therefore, at intervals, the voltage must be restored to the original state to prevent ions from adhering to the alignment film. Generally, the electric field applied to the liquid crystal molecules is directional. In different time periods, an electric field in the opposite direction is applied to the liquid crystal molecules, which is called "polarity inversion". That is, the voltage applied to the liquid crystal molecules is a symmetric positive voltage and a negative voltage. In practical applications, the pixel voltage is divided into a positive-polarity and a negative-polarity, and the pixel voltage is a data voltage minus a feedthrough voltage, wherein the feedthrough voltage is a voltage drop caused by the gate voltage coupling the pixel electrode. The gate voltage and the data voltage have different voltage drops in different areas of the liquid crystal display panel, so the positive and negative pixel voltages cannot be completely symmetrical in all areas by the compensation of a single Vcom. Therefore, when the liquid crystal panel is loaded with the same image for a long time, charged ions in the liquid crystal are adsorbed on both ends of the liquid crystal above and below the glass to generate a built-in electric field. When the screen is switched, the ions cannot be released immediately, so that the liquid crystal molecules are not immediately deflected to the corresponding angle, causing the current picture to retain the information of the previous picture, called ghost. Therefore, how to improve the ghost problem of the liquid crystal display panel has become an urgent problem to be solved.

SUMMARY OF THE DISCLOSURE

In order to solve the defects and deficiencies of the prior art, embodiments of the present invention provide a ghost relieving circuit for a display panel, a display panel, and a ghost relieving method for a display panel.

In a first aspect, a ghost relieving circuit for a display panel according to an embodiment of the present invention includes: a digital-to-analog converter, a first switching circuit, a second switching circuit, and a gamma chip; wherein the gamma chip is connected to the digital-to-analog converter and configured to provide a plurality of reference voltages to the digital-to-analog converter, the digital-to-analog converter is individually connected to the first switching circuit and the second switching circuit, the first switching circuit is connected to receive a first working voltage and a positive-polarity reference voltage and has an positive-polarity data voltage output end, the second switching circuit is connected to receive a second working voltage and a negative-polarity reference voltage and has a negative-polarity data voltage output end, and the positive-polarity reference voltage is less than the negative-polarity reference voltage.

In an embodiment of the present invention, the first switching circuit includes a first switching transistor and a second switching transistor. The positive output end of the digital-to-analog converter is connected to the control end of the first switching transistor and the control end of the second switching transistor; the first end of the first switching transistor is connected to receive the first working voltage, a node formed by connecting the second end of the first switching transistor and the first end of the second switching transistor in series is used as the positive-polarity data voltage output end, and the second end of the second switching transistor is connected to receive the positive-polarity reference voltage.

In an embodiment of the present invention, the first switching transistor is a P-type transistor, and the second switching transistor is an N-type transistor.

In an embodiment of the present invention, the second switching circuit includes a third switching transistor and a fourth switching transistor. The negative output end of the digital-to-analog converter is connected to the control end of the third switching transistor and the control end of the fourth switching transistor; the first end of the third switching transistor is connected to receive the negative-polarity reference voltage, a node formed by connecting the second end of the third switching transistor and the first end of the fourth switching transistor in series is used as the negative-polarity data voltage output end, and the second end of the fourth switching transistor is connected to receive the second working voltage.

In an embodiment of the present invention, the third switching transistor is a P-type transistor, and the fourth switching transistor is an N-type transistor.

In an embodiment of the present invention, the plurality of reference voltages include a first reference voltage, a second reference voltage, a third reference voltage, and a fourth reference voltage in an order from the largest to the smallest as per voltage values thereof; the first reference voltage, the second reference voltage, the third reference voltage, and the fourth reference voltage are corresponding to a highest gray scale of positive polarity, a lowest gray scale of negative polarity, a lowest gray scale of positive polarity, and a highest gray scale of negative polarity respectively; the first working voltage is greater than the first reference voltage, the positive-polarity reference voltage is less than the third reference voltage and greater than the second working voltage, the negative-polarity reference voltage is greater than the second reference voltage and less than the first working voltage, the second working voltage is less than the fourth reference voltage. The voltage range from the positive-polarity reference voltage to the first working voltage and the voltage range from the negative-polarity reference voltage to the second working voltage have an overlapped range.

In an embodiment of the present invention, the ghost relieving circuit is applied to a source driver of the display panel, positive gray scale ranges corresponding to different areas of the display panel respectively are different, and negative gray scale ranges corresponding to the different areas respectively are different.

Compared with the prior art, the first aspect of the present invention has the following beneficial effects: the ghost relieving circuit can keep the common voltage Vcom unchanged. By adjusting the positive-polarity reference voltage and the negative-polarity reference voltage, the voltage range of the positive-polarity reference voltage to the first working voltage and the voltage range of the negative-polarity reference voltage to the second working voltage have an overlapped range. The pixel voltage of the entire display panel can be symmetrical with respect to the common voltage Vcom, thereby reducing the ghost of the display panel. Moreover, the output buffer formed by the first switching transistor and the second switching transistor of the ghost relieving circuit provided by the present invention only needs to be close to the highest and lowest differential pressure of the half width, thereby effectively improving the driving force and reducing the cost, and ensuring the state of the display content of the display panel.

In a second aspect, the present invention provides a display panel including a timing controller, configured to form a scan line control timing, a first data line control timing, and a second data line control timing, wherein the first data line control timing and the second data line control timing are formed respectively according to a first gray scale and a second gray scale formed from an original image gray scale; a gate driver, connected to the timing controller and configured to receive the scan line control timing and thereby generate a scan line voltage signal; a source driver, connected to the timing controller and configured to receive the first data line control timing and the second data line control timing and thereby generate a first data line voltage signal and a second data line voltage signal respectively; and a pixel matrix, connected to the gate driver and the source driver and configured to perform displaying of an image according to the scan line voltage signal, the first data line voltage signal, and the second data line voltage signal.

In an embodiment of the present invention, the timing controller includes a sub-pixel lookup table, the sub-pixel lookup table is configured to form the first gray scale and the second gray scale according to the original image gray scale.

In an embodiment of the present invention, the sub-pixel lookup table includes original image gray scales of sub-pixels at predetermined positions, first gray scales corresponding to the original image gray scales, and second gray scales corresponding to the original image gray scales.

In an embodiment of the present invention, the timing controller is further configured to determine whether a sub-pixel to be displayed corresponding to the original image gray scale is the sub-pixel at the predetermined position; if yes, search the sub-pixel lookup table according to the original image gray scale corresponding to the sub-pixel to be displayed to thereby determine the first gray scale and the second gray scale corresponding to the sub-pixel to be displayed; if not, calculate the first gray scale and the second gray scale corresponding to the sub-pixel to be displayed by using an interpolation algorithm according to the sub-pixel lookup table.

In an embodiment of the present invention, the timing controller is further configured to perform frame rate control on a sub-pixel of the pixel matrix; the frame rate control specifically includes adjusting a ratio of occurrence time of different gray scales for the sub-pixel in a time period of a plurality of image frames.

In an embodiment of the present invention, the timing controller is further configured to perform dithering on a plurality of sub-pixels of the pixel matrix; the dithering specifically includes adjusting a ratio of positional arrangement of different gray scales for ones of the plurality of sub-pixels in a same image frame.

In an embodiment of the present invention, the source driver includes a digital-to-analog converter, a first switching circuit, a second switching circuit, and a gamma chip. The gamma chip is connected to the digital-to-analog converter and configured to provide a plurality of reference voltages to the digital-to-analog converter. The digital-to-analog converter is connected to the first switching circuit and the second switching circuit individually. The first switching circuit is connected to receive a first working voltage and a positive-polarity reference voltage and has a positive-polarity data voltage output end. The second switching circuit is connected to receive a second working voltage and a negative-polarity reference voltage and has a negative-polarity data voltage output end, and the positive-polarity reference voltage is less than the negative-polarity reference voltage; the digital-to-analog converter is configured to receive the first data line control timing and the second data line control timing, the positive-polarity data voltage output end is configured to generate the first data line voltage signal, the negative-polarity data voltage output end is configured to generate the second data line voltage signal.

In an embodiment of the present invention, the plurality of reference voltages include a first reference voltage, a second reference voltage, a third reference voltage, and a fourth reference voltage in an order from the largest to the smallest as per voltage values thereof; the first reference voltage, the second reference voltage, the third reference voltage and the fourth reference voltage are corresponding to a highest gray scale of positive polarity, a lowest gray scale of negative polarity, a lowest gray scale of positive polarity, and a highest gray scale of negative polarity respectively. The first working voltage is greater than the first reference voltage, the positive-polarity reference voltage is less than the third reference voltage and greater than the second working voltage, the negative-polarity reference voltage is greater than the second reference voltage and less than the first working voltage, and the second working voltage is less than the fourth reference voltage. A voltage range from the positive-polarity reference voltage to the first working voltage and a voltage range from the negative-polarity reference voltage to the second working voltage have an overlapped range.

In an embodiment of the present invention, the gate driver is a COF type driving module or a GOA type driving module.

Compared with the prior art, the second aspect of the present invention has the following beneficial effects: the display panel adjusts the input voltage across the sub-pixel by keeping the Vcom voltage constant. Compared with the original method of adjusting the Vcom voltage, it is possible to more accurately control the symmetry of the positive and negative-polarity pixel voltages in the entire display panel area, and effectively reduce the ghost of the display panel.

In a third aspect, an embodiment of the present invention provides a ghost relieving method, which is applied to a display panel including a pixel matrix. The method includes acquiring input gray scales; acquiring first gray scales and second gray scales according to the input gray scales; acquiring corresponding first voltages according to the first gray scales and corresponding second voltages according to the second gray scales; and outputting the first voltages and the second voltages to a pixel matrix.

In an embodiment of the present invention, the step of acquiring first gray scales and second gray scales according to the input gray scales includes: establishing a lookup table for sub-pixels at predetermined positions; determining whether a sub-pixel to be displayed corresponding to one of the input gray scales is the sub-pixel at the predetermined position; if yes, searching the lookup table according to the input gray scale of the sub-pixel to be displayed, and determining the first gray scale and the second gray scale corresponding to the sub-pixel to be displayed; if not, calculating the first gray scale and the second gray scale corresponding to the sub-pixel to be displayed by using an interpolation algorithm according to the lookup table.

In an embodiment of the present invention, the step of establishing a lookup table for sub-pixels at predetermined positions includes: selecting the sub-pixels at the predetermined positions; determining input gray scales, first gray scales and second gray scales, corresponding to the sub-pixels at the predetermined positions; and storing the input gray scales, the first gray scales, and the second gray scales and thereby forming the lookup table.

In an embodiment of the present invention, before the step of acquiring corresponding first voltages according to the first gray scales and corresponding second voltages according to the second gray scales, further includes performing frame rate control according to the first gray scales and the second gray scales.

In an embodiment of the present invention, before the step of acquiring corresponding first voltages according to the first gray scales and corresponding second voltages according to the second gray scales, further including performing dithering according to the first gray scales and the second gray scales.

In a fourth aspect, an embodiment of the present invention provides a ghost relieving apparatus including a signal input module configured to acquire an input gray scale; a gray scale processing module, configured to acquire a first gray scale and a second gray scale according to the input gray scale; a voltage conversion module, configured to acquire a corresponding first voltage and a second voltage according to the first gray scale and the second gray scale respectively; and a signal output module, configured to output the first voltage and the second voltage to the pixel matrix.

In an embodiment of the present invention, the gray scale processing module includes: a lookup table establishing unit, configured to establish a lookup table for sub-pixels at predetermined positions; a sub-pixel determining unit, configured to determine whether a current sub-pixel of the liquid crystal display device to be displayed corresponding to one of the input gray scale is a selected number of the sub-pixels at the predetermined position; if yes, the lookup table is searched according to the input gray scale of the sub-pixel to be displayed, and the first gray scale and the second gray scale corresponding to the sub-pixel to be displayed corresponding to the input gray scale is determined; if not, the first gray scale and the second gray scale corresponding to the input gray scale of the sub-pixel to be displayed are calculated by using an interpolation algorithm according to the lookup table.

In an embodiment of the present invention, the lookup table establishing unit is configured to select a plurality of sub-pixels at the predetermined position, determine the input gray scale, the first gray scale and the second gray scale corresponding to the sub-pixel at the predetermined position, and store the input gray scale, the first gray scale and the second gray scale to form the lookup table.

In an embodiment of the present invention, the ghost relieving apparatus further includes a frame rate control module, configured to perform frame rate control according to the first gray scale and the second gray scale before the voltage conversion module acquires a corresponding first voltage according to the first gray scale and a second voltage according to the second gray scale respectively.

In an embodiment of the present invention, the ghost relieving apparatus further includes a dithering module configured to perform dithering according to the first gray scale and the second gray scale before the voltage conversion module acquires a corresponding first voltage according to the first gray scale and a second voltage according to the second gray scale respectively.

Compared with the prior art, the third and fourth aspects of the present invention have the following beneficial effects: the method and the apparatus of this embodiment adjusts the voltage across the sub-pixel by keeping the Vcom voltage constant. Compared with the original method of adjusting the Vcom voltage, it is possible to more accurately control the symmetry of the positive and negative-polarity pixel voltages in the entire display panel area. That is, the pixel voltage of the entire display panel is symmetrical with respect to Vcom, which effectively reduces the image sticking of the display panel.

BRIEF DESCRIPTION OF THE DRAWINGS

In order to more clearly illustrate the technical solutions of the embodiments of the present application, the drawings used in the description of the embodiments will be briefly described below. Obviously, the drawings in the following description are only some of the embodiments of the present application, and those skilled in the art can obtain other drawings according to the drawings without any creative work.

DETAILED DESCRIPTION OF PREFERRED EMBODIMENTS

The technical solutions in the embodiments of the present application are clearly and completely described in the following with reference to the accompanying drawings in the embodiments of the present application. It is apparent that the described embodiments are only a part of the embodiments of the present application, and not all of them. All other embodiments obtained by a person of ordinary skill in the art based on the embodiments of the present application without departing from the inventive scope are the scope of the present application.

Embodiment 1

Figure 2:
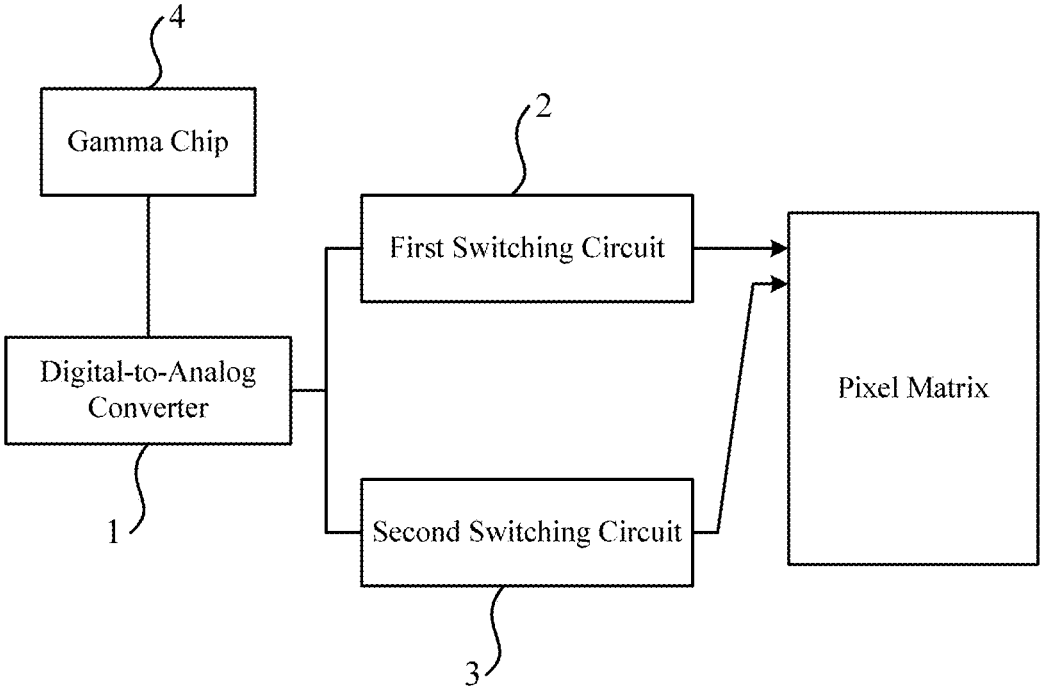
FIG. 2 is a schematic block diagram of a ghost relieving circuit for a display panel according to an embodiment of the present invention.
Figure 3:
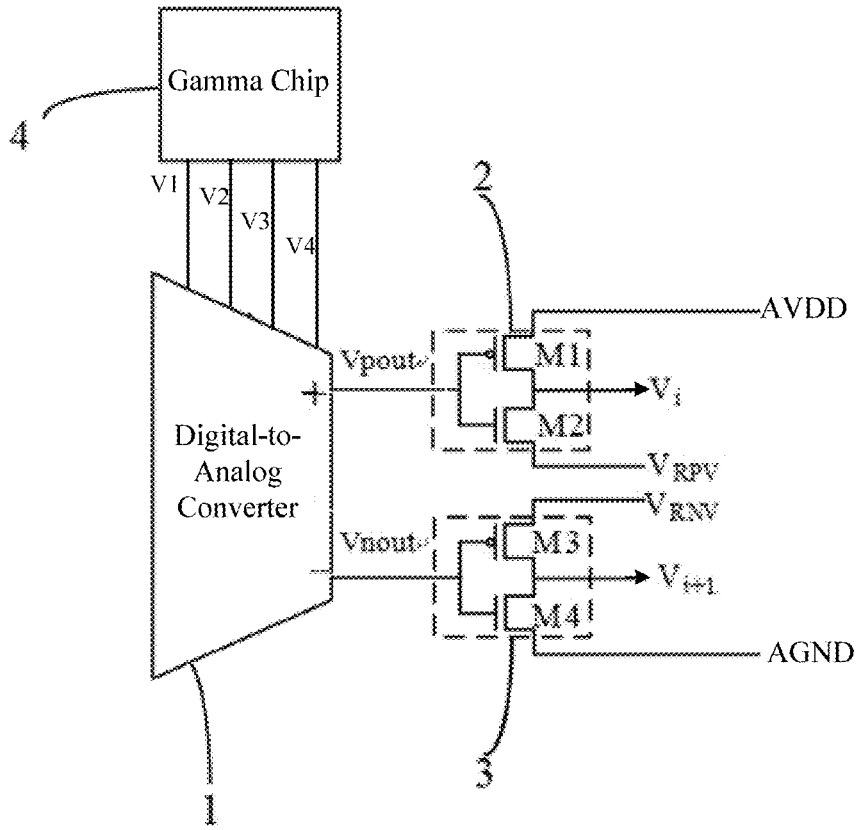
FIG. 3 is a schematic diagram of a specific circuit structure of a ghost relieving circuit for a display panel according to an embodiment of the present invention.

Please refer to FIG. 2 and FIG. 3, FIG. 2 is a schematic block diagram of a ghost relieving circuit for a display panel according to an embodiment of the present invention. FIG. 3 is a schematic diagram of a specific circuit structure of a ghost relieving circuit for a display panel according to an embodiment of the present invention. Specifically, the ghost relieving circuit includes a digital-to-analog converter 1, a first switching circuit 2, a second switching circuit 3, and a gamma chip 4.

The digital-to-analog converter 1 is connected to the first switching circuit 2 and the second switching circuit 3, the gamma chip 4 is connected to the digital-to-analog converter 1 for providing a plurality of reference voltages to the digital-to-analog converter 1.

In an embodiment of the invention, the first switching circuit 2 includes a first switching transistor M1 and a second switching transistor M2. The positive output end Vpout of the digital-to-analog converter 1 is connected to the control end of the first switching transistor M1 and the control end of the second switching transistor M2. The first end of the first switching transistor M1 is connected to receive the first working voltage AVDD, a node formed by connecting the second end of the first switching transistor M1 and the first end of the second switching transistor M2 in series is used as an output end of the positive-polarity data voltage $V_i$ to provide a positive-polarity data voltage $V_i$ to the pixel matrix of the display panel. The second end of the second switching transistor M2 is connected to receive the positive-polarity reference voltage $V_{RPV}$.

In an embodiment of the invention, the first switching transistor M1 is a P-type transistor, and the second switching transistor M2 is an N-type transistor.

In an embodiment of the invention, the second switching circuit 3 includes a third switching transistor M3 and a fourth switching transistor M4. The negative output end Vnout of the digital-to-analog converter 1 is connected to the control end of the third switching transistor M3 and the control end of the fourth switching transistor M4. The first end of the third switching transistor M3 is connected to receive the negative-polarity reference voltage $V_{RNV}$. A node formed by the second end of the third switching transistor M3 and the first end of the fourth switching transistor M4 being connected in series is used as an output end of the negative-polarity data voltage $V_{i+1}$ to provide a negative-polarity data voltage $V_{i+1}$ to the pixel matrix of the display panel. The second end of the fourth switching transistor M4 is connected to receive the second working voltage AGND.

In one embodiment of the invention, the third switching transistor M3 is a P-type transistor, and the fourth switching transistor M4 is an N-type transistor.

In an embodiment of the invention, the positive-polarity reference voltage $V_{RPV}$ is less than the negative-polarity reference voltage $V_{RNV}$ such that a voltage range from the positive-polarity reference voltage $V_{RPV}$ to the first working voltage AVDD and a voltage range from the negative-polarity reference voltage $V_{RNV}$ to the second working voltage AGND have an overlapped range.

The ghost relieving circuit provided by the embodiment of the invention can keep the common voltage Vcom unchanged. By adjusting the positive-polarity reference voltage $V_{RPV}$ and the negative-polarity reference voltage $V_{RNV}$, the voltage range of the positive-polarity reference voltage $V_{RPV}$ to the first working voltage AVDD and the voltage range of the negative-polarity reference voltage $V_{RNV}$ to the second working voltage AGND have an overlapped range. The pixel voltage of the entire display panel can be symmetrical with respect to the common voltage Vcom, thereby reducing the ghost of the display panel.

Embodiment 2

Figure 1:
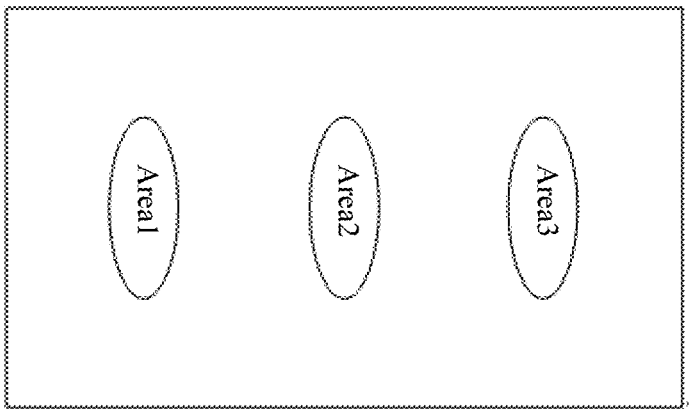
FIG. 1(Related Art)
FIG. 1 is a schematic diagram of three areas in a liquid crystal display panel provided by the prior art.
Figure 4:
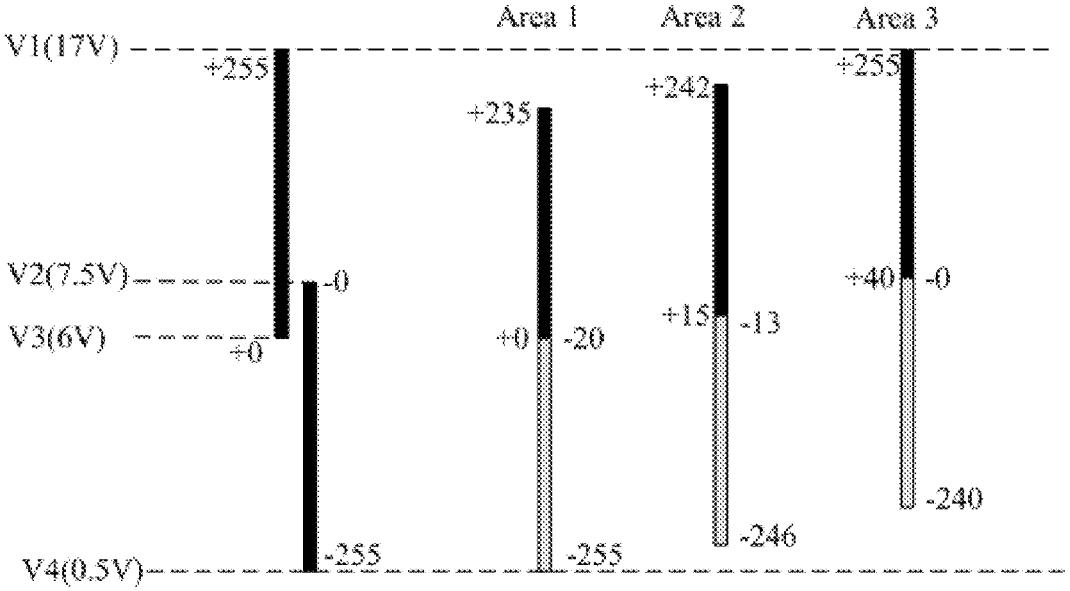
FIG. 4 is a schematic diagram of a gray scale offset manner according to an embodiment of the present invention.

Please refer to FIG. 1 to FIG. 3 again, and see also FIG. 4, FIG. 4 is a schematic diagram of a gray scale offset manner according to an embodiment of the present invention. A ghost relieving circuit of a display panel according to an embodiment of the present invention will be described in detail below. As shown in FIG. 2, the ghost relieving circuit includes a digital-to-analog converter 1, a first switching circuit 2, a second switching circuit 3, and a gamma chip 4. The digital-to-analog converter 1 is connected to the first switching circuit 2 and the second switching circuit 3. The gamma chip 4 is connected to the digital-to-analog converter 1 for providing a plurality of reference voltages to the digital-to-analog converter 1.

Specifically, as shown in FIG. 3, the first switching circuit 2 includes a first switching transistor M1 and a second switching transistor M2, and the second switching circuit 3 includes a third switching transistor M3 and a fourth switching transistor M4. The positive output end Vpout of the digital-to-analog converter 1 is individually connected to a node formed by the gate of the first switching transistor M1 and the gate of the second switching transistor M2. The negative output end Vnout of the digital-to-analog converter 1 is connected to a node individually formed by the gate of the third switching transistor M3 and the gate of the fourth switching transistor M4.

The first end of the first switching transistor M1 is connected to the first working voltage AVDD, a node formed by connecting the second end of the first switching transistor M1 and the first end of the second switching transistor M2 in series is used as an output end of the positive-polarity data voltage $V_i$ to provide a positive-polarity data voltage $V_i$ to the pixel matrix of the display panel. The second end of the second switching transistor M2 is connected to the positive-polarity reference voltage $V_{RPV}$. The first end of the first switching transistor M1 is a source, and the second end of the first switching transistor M1 is a drain. The first end of the second switching transistor M2 is a drain, and the second end of the second switching transistor M2 is a source.

In one embodiment of the present invention, the Gamma chip 4 provides four reference voltages V1, V2, V3 and V4 to the digital-to-analog converter 1; as an example, the values of V1 to V4 are V1=17V, V2=7.5V, V3=6V, and V4=0.5V, respectively. Furthermore, the first working voltage AVDD>V1 (e.g., >17V), the positive-polarity reference voltage $V_{RPV}$<V3 (e.g., <6V) and $V_{RPV}$>AGND, the negative-polarity reference voltage $V_{RNV}$>V2 (e.g., >7.5V) and $V_{RNV}$<AVDD, the second working voltage AGND<V4 (e.g., <0.5V). In addition, in FIG. 4, the four reference voltages V1, V2, V3, and V4 correspond to the highest gray scale of positive-polarity (+255), the lowest gray scale of negative-polarity (−0), the lowest gray scale of positive-polarity (+0), and the highest gray scale of negative-polarity (−255).

In one embodiment of the invention, the first switching transistor M1 is a P-type transistor and the second switching transistor M2 is an N-type transistor.

In the above, the first end of the third switching transistor M3 is connected to the negative-polarity reference voltage $V_{RNV}$, a node formed by connecting the second end of the third switching transistor M3 and the first end of the fourth switching transistor 32 in series is used as an output terminal of the negative-polarity data voltage $V_{i+1}$ to provide a negative-polarity data voltage $V_{i+1}$ to the pixel matrix of the display panel. The second end of the fourth switching transistor 32 is connected to receive the second voltage end of the Gamma chip 4, the first end of the third switching transistor M3 is a source, the second end of the third switching transistor M3 is a drain, the first end of the fourth switching transistor 32 is a drain, the second end of the fourth switching transistor 32 is a source.

In one embodiment of the invention, the third switching transistor M3 is a P-type transistor and the fourth switching transistor M4 is an N-type transistor.

In an embodiment of the invention, the positive-polarity reference voltage $V_{RPV}$ is smaller than the negative-polarity reference voltage $V_{RNV}$ to have an overlapped range of the voltage range of the positive-polarity reference voltage $V_{RPV}$ to the first working voltage AVDD and the voltage range of the negative-polarity reference voltage $V_{RNV}$ to the second working voltage AGND.

More specifically, each sub-pixel corresponds to a positive gray scale and a negative gray scale. After the positive-polarity gray scale and the negative-polarity gray scale are converted into the corresponding positive-polarity data voltage $V_i$ and the negative-polarity data voltage $V_{i+1}$, the positive-polarity data voltage $V_i$ corresponds to the positive-polarity reference voltage $V_{RPV}$, and the negative-polarity data voltage $V_{i+1}$ corresponds to the negative-polarity reference voltage $V_{RNV}$. Wherein, the positive gray scale and the negative gray scale can be determined by testing, or can be obtained by calculation.

Further, as shown in FIG. 1, for example, three areas are selected in the display panel, including the area 1, the area 2, and the area 3. The positive gray scale and the negative gray scale corresponding to each input gray scale of the area 2 are tested. Assuming that the input gray scale of area 2 is 0, the positive gray scale of area 2 is +15 gray scale, and the negative gray scale of area 2 is −13 gray scale. Due to the problem of symmetry, as shown in FIG. 4, the positive gray scale of area 1 is +0 gray scale, the negative gray scale of area 1 is −20 gray scale, the positive gray scale of area 3 is +40 gray scale, and the negative gray scale of area 3 is −0 gray scale. Thereby, the common voltage Vcom is kept constant on the display panel. By setting the positive-polarity reference voltage $V_{RPV}$ to be smaller than the negative-polarity reference voltage $V_{RNV}$, the voltage range of the positive-polarity reference voltage $V_{RPV}$ to the first working voltage AVDD and the voltage range of the negative-polarity reference voltage $V_{RNV}$ to the second working voltage AGND can have an overlapped range. Thus, the area 1 and the area 3 are respectively shifted by a plurality of gray scale values by adjusting the voltage level of the overlapped range, thereby causing the ghost to be relieved. In addition, as can be seen from FIG. 4, the positive gray scale range of different areas on the display panel is different, and the negative gray scale range is also different; for example, the positive gray scale ranges of area 1, area 2, and area 3 are: +0~+235, +15~+242, and +40~+255; the negative gray scale ranges are: −20~−255, −13~−246 and −0~−240.

In summary, the ghost relieving circuit provided by the embodiment of the present invention can keep the common voltage Vcom unchanged. By adjusting the positive-polarity reference voltage and the negative-polarity reference voltage, the voltage range of the positive-polarity reference voltage $V_{RPV}$ to the first working voltage AVDD and the voltage range of the negative-polarity reference voltage $V_{RNV}$ to the second working voltage AGND have an overlapped range, the pixel voltage of the entire display panel can be symmetrical with respect to the common voltage Vcom, thereby reducing the ghost of the display panel.

Embodiment 3

Figure 5:
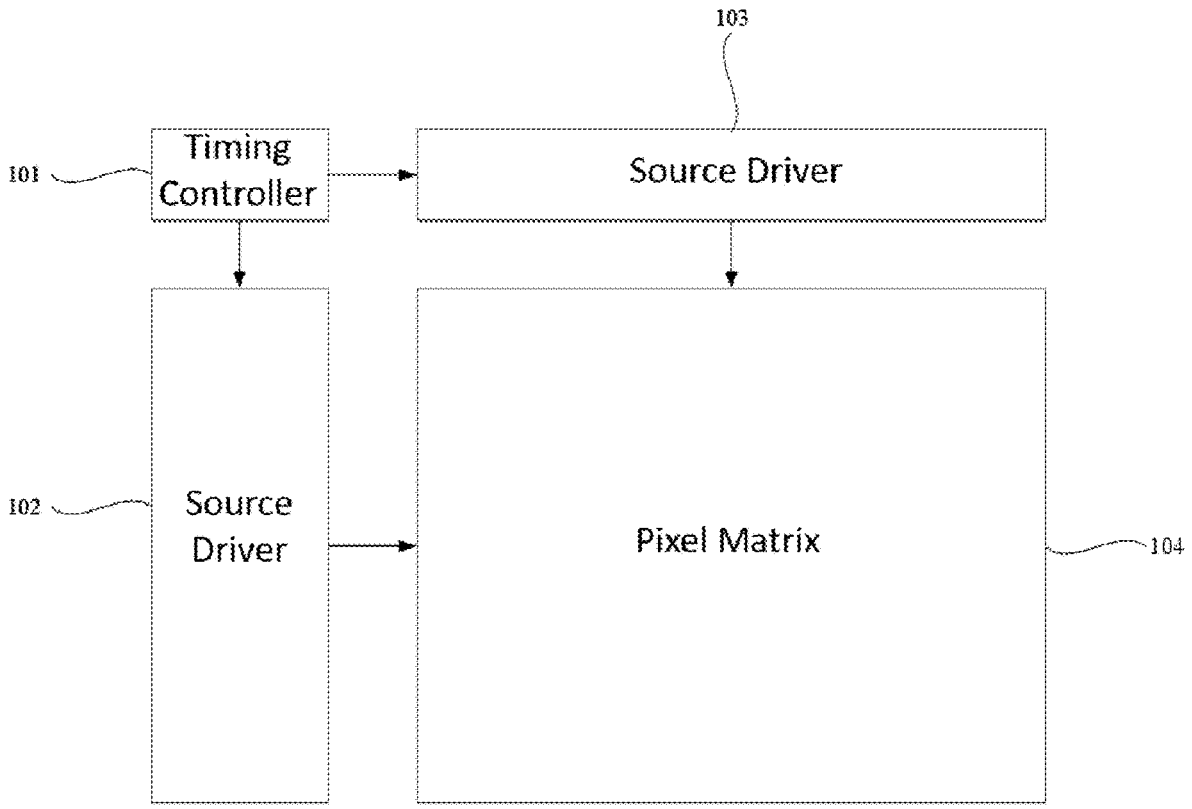
FIG. 5 is a schematic structural diagram of a liquid crystal display panel according to an embodiment of the present invention.

Referring to FIG. 5, FIG. 5 is a schematic structural diagram of a liquid crystal display panel according to an embodiment of the present invention. The liquid crystal display panel of this embodiment includes a timing controller 101, a gate driver 102, a source driver 103, and a pixel matrix 104.

The timing controller 101 is configured to form a scan line control timing, a first data line control timing, and a second data line control timing, the first data line control timing and the second data line control timing are formed respectively according to the first gray scale and the second gray scale formed from the original image gray scale (also known as input image gray scale).

In one embodiment, the timing controller 101 includes a sub-pixel lookup table, and the lookup table is composed of original image gray scales corresponding to sub-pixels at predetermined positions, corresponding first gray scales, and corresponding second gray scales. The first gray scale and the second gray scale are symmetric positive gray scales and negative gray scales. The positive-polarity gray scale and the negative-polarity gray scale are converted into corresponding positive-polarity voltages and negative-polarity voltages. The timing controller 101 is further configured to determine whether the sub-pixel to be displayed corresponding to the gray scale of the original image is the sub-pixel at the predetermined position; if yes, the lookup table is searched according to the gray scale corresponding to the original image of the sub-pixel to be displayed thereby determine the first gray scale and the second gray scale corresponding to the sub-pixel to be displayed; if not, calculate the first gray scale and the second gray scale corresponding to the sub-pixel to be displayed by using an interpolation algorithm according to the sub-pixel lookup table. So far, the first gray scale corresponding to the original image gray scale and the second gray scale are formed by the sub-pixel lookup table. The timing controller 101 forms the first data line control timing and the second data line control timing according to the first gray scale and the second gray scale combined with a display clock period of the original image.

Furthermore, the timing controller 101 is further configured to perform frame rate control and dithering on the sub-pixels of the pixel matrix.

Specifically, the frame rate control is generated by using a color mixing effect in time to generate more gray scale effects, that is, adjusting a time ratio of different gray scales of the sub-pixels in a time period of the plurality of image frames; the dithering is to generate more gray scale effects by the spatial color mixing effect, that is, to adjust the positional arrangement ratios of the different gray scales of the plurality of sub-pixels in the plurality of sub-pixels of the same image frame.

The gate driver 102 is connected to the timing controller 101 for receiving the scan line control timing of the timing controller 101 and generating a scan line voltage signal.

Specifically, the gate driver is a chip on film (COF) type driving module or a gate driver on array (GOA) type driving module.

The source driver 103 is coupled to the timing controller 101 for receiving the first data line control timing and the second data line control timing and generating a first data line voltage signal and a second data line voltage signal respectively. For example, the source driver 103 of the present embodiment has the ghost relieving circuit shown in FIGS. 2 and 3. Correspondingly, the first data line control timing corresponds to a positive-polarity gray scale, and the second data line control timing corresponds to a negative-polarity gray scale, the first data line voltage signal corresponds to a positive-polarity data voltage $V_i$, and the second data line voltage signal corresponds to a negative-polarity data voltage $V_{i+1}$, each of the adjacent two data lines on the display panel is connected to the positive-polarity data voltage $V_i$ and the negative-polarity data voltage $V_{i+1}$ through a multiplexer (MUX).

The pixel matrix 104 is connected to the gate driver 102 and the source driver 103 for performing image display according to the scan line voltage signal, the first data line voltage signal, and the second data line voltage signal.

Specifically, in the current frame, the scan line voltage signal is input to a gate of a TFT transistor in the pixel matrix 104, the TFT transistor is turned on, and the first data line voltage signal is input to a source of the TFT transistor in the pixel matrix 104 to drive display of the sub-pixel; in the next frame, the scan line voltage signal is input to the gate of the TFT transistor in the pixel matrix 104, the TFT transistor is turned on, and the second data line voltage signal is input to a source of the TFT transistor in the pixel matrix 104 to drive display of the sub-pixel.

In summary, the liquid crystal display panel provided in this embodiment can accurately control the voltage symmetry of the entire pixel matrix 104 by converting the input gray scale of the sub-pixel matrix 104 into two gray scales in the timing controller 101, thereby solving the ghost problem of the display panel.

Embodiment 4

Please continue to see FIG. 5. This embodiment describes the method for relieving the ghost corresponding to the liquid crystal display panel proposed by the embodiment of the present invention in detail based on the third embodiment.

(i) Selecting a plurality of sub-pixels in the pixel matrix, and determining first gray scales and second gray scales of the sub-pixels.

Specifically, the first gray scales and the second gray scales are a positive gray scale and a negative gray scale. The positive-polarity gray scale and the negative-polarity gray scale can be converted into corresponding positive-polarity data voltage and negative-polarity data voltage. The first gray scales and the second gray scales may be determined by testing, or may be obtained by calculation.

Figure 6:
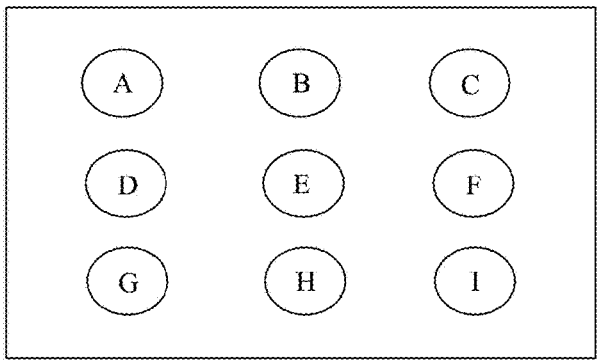
FIG. 6 is a schematic diagram of a liquid crystal display panel with 9 sub-pixels according to an embodiment of the present invention.
Figure 7A:
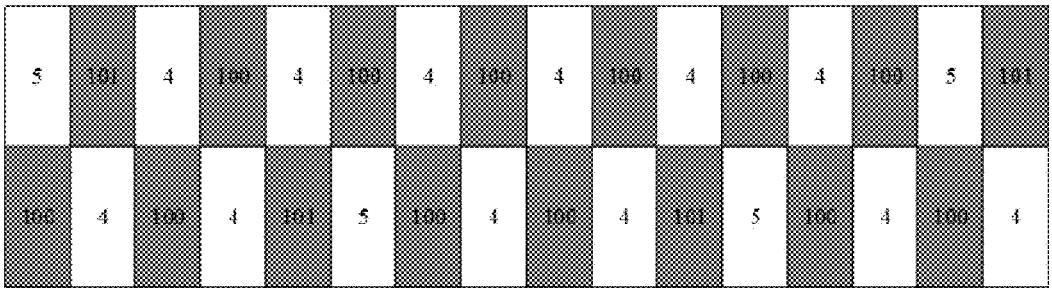
FIG. 7*a* to FIG. 7*d* are schematic diagrams of frame rate control and dithering of a liquid crystal display panel according to an embodiment of the present invention.
Figure 7B:
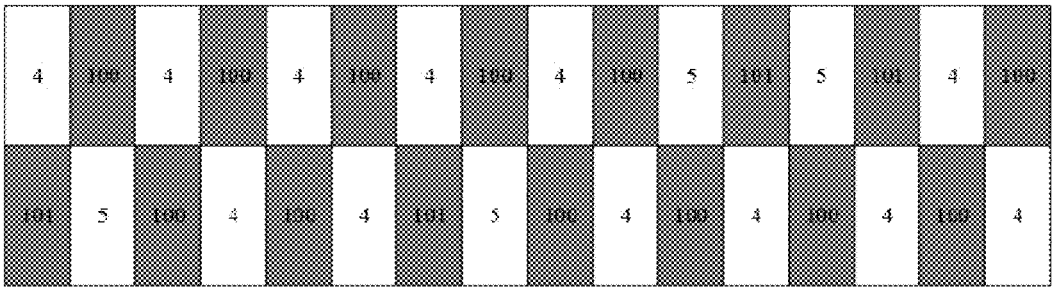
Figure 7C:
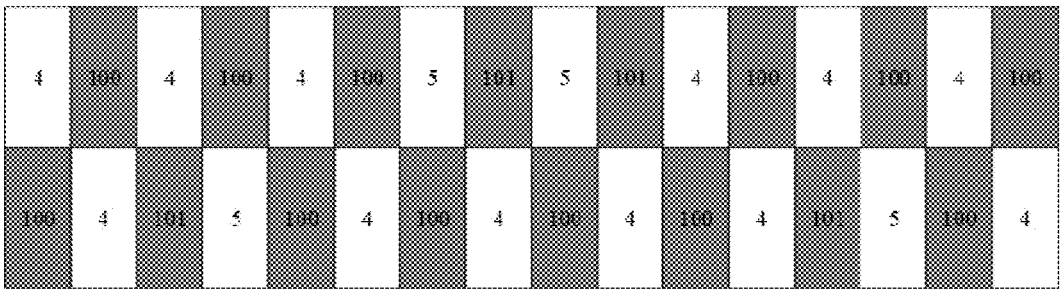
Figure 7D:
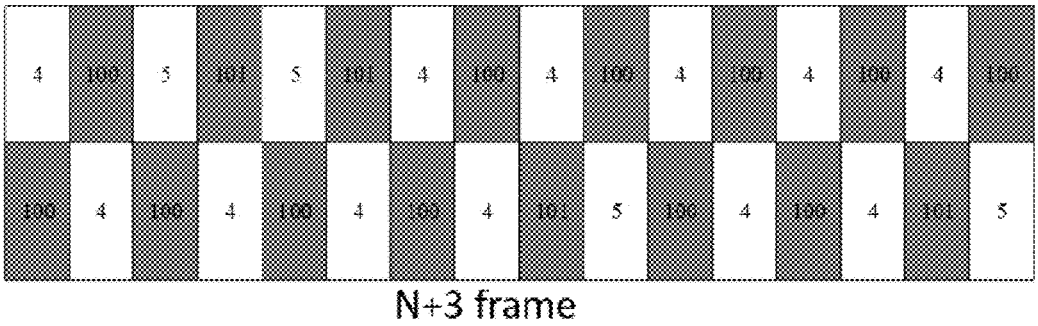

Further, as shown in FIG. 6, FIG. 6 is a schematic diagram of a liquid crystal display panel with 9 sub-pixels according to an embodiment of the present invention. For example, 9 sub-pixels are selected in the pixel matrix, and the sub-pixel A is taken as an example to test the first gray scale and the second gray scale corresponding to each input gray scale of the sub-pixel A. Assume that the input gray scale of the sub-pixel A is 255. In the conventional display mode, it is not necessary to obtain the negative gray scale, and 255 is used as the positive gray scale, and −255 is used as the negative gray scale. In the present invention, the positive gray scale 255 and the negative gray scale −255 of the input gray scale 255 may be offset by a plurality of gray scale values, respectively. The positive-polarity data voltage (e.g. $V_i$ in FIG. 3) and the negative-polarity data voltage (e.g. $V_{i+1}$ in FIG. 3) corresponding to the positive-polarity gray scale and the negative-polarity gray scale after the offset pass through the Feedthrough voltage, and Vcom is the symmetry axis. The offset of the gray scale value is obtained by testing the sub-pixel A. The positive gray scale 255 and the offset are calculated to obtain a first gray scale corresponding to an input gray scale of 255. The negative gray scale −255 and the offset are calculated to obtain a second gray scale corresponding to the input gray scale of 255. Continue testing to get the first gray scale and the second gray scale of the other input gray scales of the sub-pixel A. The other sub-pixel reference sub-pixel A acquires the first gray scale and the second gray scale corresponding to the input gray scale.

Preferably, in the conventional display mode, the positive gray scale and the negative gray scale corresponding to the input gray scale are mapped to the positive gray scale table, for example, a positive gray scale table with a positive gray scale corresponding to the input gray scale and a positive gray scale with a negative gray scale range of −511 to 511 is mapped to a positive gray scale table of 0 to 1023. The positive gray scale and the negative gray scale corresponding to the gray pixel 255 of the sub-pixel A are determined in the positive gray scale table of 0 to 1023, and the offset of the sub-pixel A input to the gray scale 255 is tested. The positive gray scale and the offset in the positive gray scale table are calculated to obtain the first gray scale corresponding to the input gray scale of 255. The negative gray scale and the offset in the positive gray scale table are calculated to obtain a second gray scale corresponding to the input gray scale of 255. The other sub-pixels obtain the first gray scale and the second gray scale corresponding to the input gray scale with reference to the mode.

(ii) Inputting the gray scales, the first gray scale, and the second gray scale corresponding to the selected sub-pixels to form a lookup table.

Specifically, forming a lookup table for the input gray scale, the first gray scale, and the second gray scale of each sub-pixel according to the first gray scale and the second gray scale corresponding to the gray scale input of each sub-pixel obtained in the step (i).

Further, for example, the range of the input gray scale of the sub-pixel A from 0 to 1023, and according to the step (i), the first gray scale and the second gray scale corresponding to the input gray scales of 0 to 1023 are respectively obtained. The input gray scale, the first gray scale, and the second gray scale form a lookup table, and the other sub-pixels refer to the sub-pixel A to form a lookup table.

(iii) acquiring a first gray scale and a second gray scale according to input gray scales of each sub-pixel in the pixel matrix.

Specifically, determining whether the current sub-pixel in the liquid crystal display panel is a plurality of sub-pixels selected in step (i); if yes, the first gray scale corresponding to the current sub-pixel input gray scale and the second gray scale are searched in the lookup table obtained in the step (ii), and the first gray scale corresponding to the current input pixel gray scale is obtained; if not, according to the lookup table of all the sub-pixels obtained in step (ii), the first gray scale and the second gray scale corresponding to the current input gray scale of the current sub-pixel are calculated by an interpolation algorithm.

Further, for example, different input gray scales of the sub-pixels A to I in the liquid crystal display panel use the sub-pixel A to I lookup table to determine the first gray scale and the second gray scale corresponding to different input gray scales. It is assumed that the sub-pixel K is located in the middle of the sub-pixel A, the sub-pixel B, the sub-pixel D, and the sub-pixel E, the first gray scale and the second gray scale corresponding to the current input gray scale of the sub-pixel K may be interpolated by using the first gray scale and the second gray scale corresponding to the current gray scale in the lookup table of the sub-pixel A, the sub-pixel B, the sub-pixel D and the sub-pixel E, thereby acquiring the first gray scale and the second gray scale corresponding to the current input gray scale of the sub-pixel K.

(iv) Performing frame rate control and dithering operations based on the first gray scale and the second gray scale.

Specifically, as can be seen from the above steps, when determining the first gray scale and the second gray scale of the sub-pixel, the positive gray scale and the negative gray scale in the positive gray scale table need to be asymmetrically offset to obtain the first gray scale and the second gray scale. The number of bits of the first gray scale and the second gray scale may exceed the number of bits that the digital drive circuit can output. Therefore, it is necessary to perform frame rate control and dithering operations on the liquid crystal display panel to compensate for this problem.

The frame rate control (FRC) operation produces more gray scale effects through the color mixing effect over time. For example, the original gray scale range is 0~511, that is, 9-bit gray scale, and the FRC function is added. By the color mixing effect in time, the gray scale range of 0~2047 or 11-bit gray scale can be produced. The function principle is as follows: in the time of four consecutive image frames, the ratio of the appearance time of black and white is adjusted, and the viewer can obtain the intermediate gray scale display effects of 1/4 gray, 2/4 gray and 3/4 gray. Although it is a 9-bit gray scale for a single frame, the liquid crystal display device dynamically refreshes the data, and the viewer perceives the 11-bit gray scale.

The dithering operation produces more gray scale effects through spatially mixed color effects. Taking the adjacent four pixel spaces as an example, the black and white color space position arrangement ratio is adjusted, and the viewer can obtain the intermediate gray scale display effects of 1/4 gray, 2/4 gray, and 3/4 gray.

Further, in the embodiment of the present invention, the first gray scale and the second gray scale are respectively subjected to frame rate control and dithering operations. As shown in FIG. 7*a* to FIG. 7*d*, FIG. 7*a* to FIG. 7*d* are schematic diagrams showing frame rate control and dithering of a liquid crystal display panel according to an embodiment of the present invention. Among the 8 sub-pixels, four sub-pixel input gray scales correspond to the first gray scale, and the remaining four sub-pixel input gray scales correspond to the second gray scale. Wherein, the four first gray scales corresponding to the four sub-pixels satisfy at least one gray scale plus one in the space, and satisfy at least one gray scale plus one in time; the four second gray scales corresponding to the four sub-pixels, in space, satisfy at least one gray scale plus one, and in time, satisfy at least one gray scale plus one. For example, assuming that the first gray scale value of the four sub-pixels is 100, the first gray scale value of at least one sub-pixel of the four sub-pixels in space is 101, in time, that is, in the image period from the Nth frame to the N+3th frame, the first gray scale value of at least one sub-pixel is 101, and finally the first gray scale with a gray scale value of 100.25 can be obtained; assuming that the second gray scale value of the four sub-pixels is 4, the first gray scale value of at least one of the four sub-pixels in the space is 5, in time, that is, in the image period from the Nth frame to the N+3th frame, the first gray scale value of at least one sub-pixel is 5, and finally a second gray scale with a gray scale value of 4.25 can be obtained.

The number of gray scales can be increased by frame rate control and dithering operations. The frame rate control improves the resolution of the dithering, and the dithering improves the frame gradation loss of the frame rate control. The two perfectly match and complement each other, so that the best gray scale effect is mixed, and the gray scale transition is naturally smooth.

(v) Acquiring corresponding positive-polarity data voltage and negative-polarity data voltage according to the first gray scale and the second gray scale respectively.

Specifically, using the first gray scale and the second gray scale of each sub-pixel determined in the above steps, by the mapping relationship between the gray scale value and the Gamma curve, the positive-polarity data voltage corresponding to the first gray scale and the negative-polarity data voltage corresponding to the second gray scale can be determined.

(vi) Outputting a positive-polarity data voltage and a negative-polarity data voltage to the pixel matrix 104.

Specifically, the finally obtained positive-polarity pixel voltage and negative-polarity pixel voltage symmetrical with Vcom are input to each sub-pixel to complete display of the pixel matrix. For example, when transmitting the image of the Nth frame, a certain sub-pixel drives the display of the pixel matrix according to the positive-polarity data voltage. Accordingly, when the N+1th frame image is transmitted, the sub-pixel drives the display of the pixel matrix according to the negative-polarity data voltage.

In summary, the ghost relieving method provided by the embodiment obtains the positive-polarity data voltage and the negative-polarity data voltage by processing the input gray scale of the pixel matrix to drive the display of the pixel matrix. Compared with the existing positive-polarity pixel voltage and negative-polarity pixel voltage obtained by adjusting the Vcom voltage, the embodiment can accurately control the area of the entire pixel matrix to achieve optimal pixel voltage symmetry. Finally, the problem of ghost of the display panel is solved.

Embodiment 5

Figure 8:
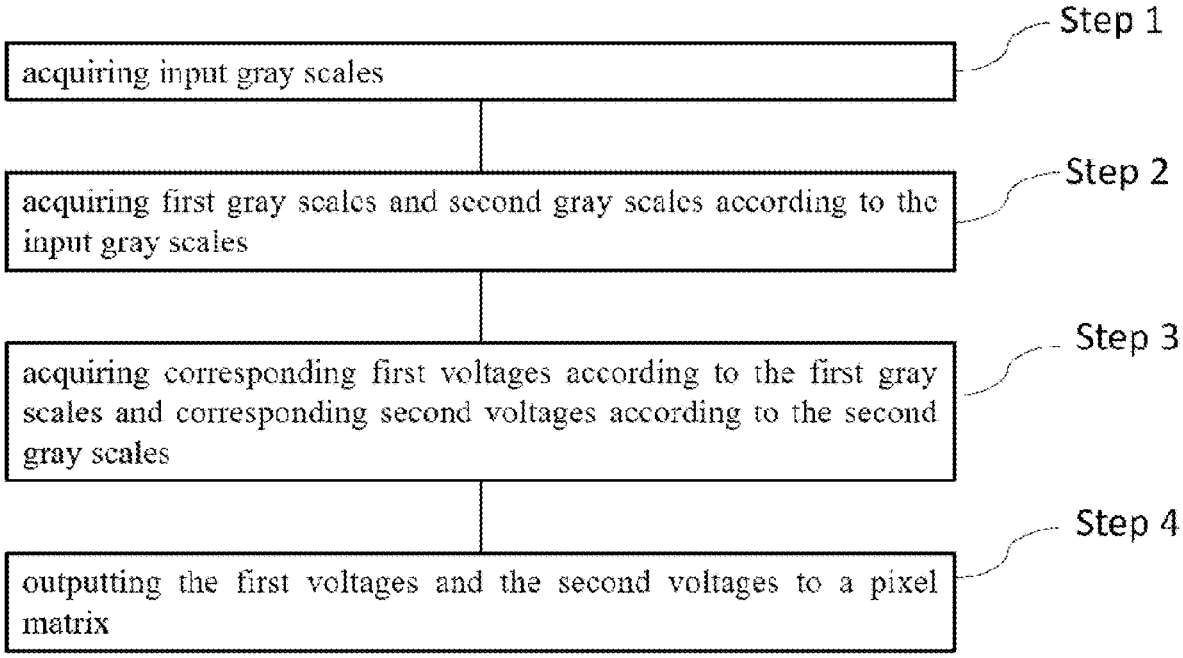
FIG. 8 is a flowchart of a ghost relieving method for a display panel according to an embodiment of the present invention.

Please refer to FIG. 8. FIG. 8 is a flowchart of a ghost relieving method for a display panel according to an embodiment of the present invention. The method for relieving the ghost is applicable to a display panel including a pixel matrix and is particularly suitable for a liquid crystal display panel. The method for relieving the ghost includes the following steps:

Step 1, acquiring input gray scales;

Step 2, acquiring first gray scales and second gray scales according to the input gray scales, wherein the first gray scales are, for example, a positive gray scale, and the second gray scales are, for example, a negative gray scale;

Step 3, acquiring corresponding first voltages according to the first gray scales and corresponding second voltages according to the second gray scales, wherein the first voltages are, for example, a positive data voltage, and the second gray scales are, for example, a negative data voltage; and Step 4, outputting the first voltages and the second voltages to a pixel matrix.

Further, the step 2 may include:

establishing a lookup table for sub-pixels at predetermined positions;

determining whether a sub-pixel to be displayed corresponding to one of the input gray scales is the sub-pixel at the predetermined position;

if yes, searching the lookup table according to the input gray scale of the sub-pixel to be displayed, and determining the first gray scale and the second gray scale corresponding to the sub-pixel to be displayed;

if not, calculating the first gray scale and the second gray scale corresponding to the sub-pixel to be displayed by using an interpolation algorithm according to the lookup table.

Further, the step of establishing a lookup table for sub-pixels at predetermined positions may include:

selecting the sub-pixels at the predetermined positions;

determining input gray scales, first gray scales, and second gray scales corresponding to the sub-pixels at the predetermined positions; and storing the input gray scales, the first gray scales, and the second gray scales and thereby forming the lookup table.

Further, before the step 3, the method further includes:

performing frame rate control according to the first gray scales and the second gray scales.

Further, before the step 3, the method further includes:

performing dithering according to the first gray scales and the second gray scales.

For specific details of the foregoing various steps in this embodiment, reference may be made to the descriptions of the foregoing embodiments in relation to FIG. 6 and FIGS. 7*a*-7*d*, and details are not described herein again.

Further, the embodiment further provides a ghost relieving apparatus suitable for a display panel, including:

a signal input module, configured to acquire input gray scales;

a gray scale processing module, configured to acquire first gray scales and second gray scales according to the input gray scales;

a voltage conversion module, configured to acquire corresponding first voltages according to the first gray scales and corresponding second voltages according to the second gray scales; and a signal output module, configured to output the first voltages and the second voltages to a pixel matrix.

The gray scale processing module includes:

a lookup table establishing unit, configured to establish a lookup table for sub-pixels at predetermined positions; and a sub-pixel determining unit, configured to determine whether current sub-pixels of the liquid crystal display device to be displayed corresponding to the input gray scales are a selected number of the sub-pixels at the predetermined positions; if yes, the lookup table is searched according to the input gray scales of the sub-pixel to be displayed thereby determine the first gray scales and the second gray scales corresponding to the sub-pixel to be displayed; if not, the first gray scales and the second gray scales corresponding to the sub-pixel to be displayed are calculated by using an interpolation algorithm according to the lookup table.

The lookup table establishing unit is configured to select a plurality of sub-pixels at the predetermined positions, determine the input gray scales, the first gray scales and the second gray scales corresponding to the sub-pixels at the predetermined positions, and store the input gray scales, the first gray scales and the second gray scales to form the lookup table.

The ghost relieving apparatus further includes a frame rate control module, configured to perform frame rate control according to the first gray scales and the second gray scales before the voltage conversion module acquires corresponding first voltages according to the first gray scales and corresponding second voltages according to the second gray scales.

The ghost relieving apparatus further includes a dithering module configured to perform dithering according to the first gray scales and the second gray scales before the voltage conversion module acquires corresponding first voltages according to the first gray scales and corresponding second voltages according to the second gray scales.

In summary, the ghost relieving method and the ghost relieving apparatus provided in this embodiment can accurately control the voltage symmetry of the entire pixel matrix by converting the input gray scales of the sub-pixels in the pixel matrix into two gray scales (e.g. positive gray scale and negative gray scale), thereby solving the ghost problem of the display panel.

In addition, it can be understood that the foregoing embodiments are merely illustrative of the present invention. The technical solutions of the various embodiments may be combined and used in any combination without departing from the technical features of the present invention.

Finally, it should be noted that the above embodiments are only used to illustrate the technical solutions of the present invention and are not limited thereto. Although the present invention has been described in detail with reference to the foregoing embodiments, those skilled in the art should understand that the technical solutions described in the foregoing embodiments may be modified or equivalently substituted for some of the technical features. The modifications and substitutions of the present invention do not depart from the spirit and scope of the technical solutions of the embodiments of the present invention.

What is claimed is:

1. A ghost relieving method for a display panel comprising a ghost relieving circuit, wherein the ghost relieving circuit comprises a digital-to-analog converter, a first switching circuit, a second switching circuit, and a gamma chip; the gamma chip is connected to the digital-to-analog converter and configured to provide a plurality of reference voltages to the digital-to-analog converter, the digital-to-analog converter is individually connected to the first switching circuit and the second switching circuit, the first switching circuit is connected to receive a first working voltage and a positive-polarity reference voltage and has an positive-polarity data voltage output end, the second switching circuit is connected to receive a second working voltage and a negative-polarity reference voltage and has a negative-polarity data voltage output end, and the positive-polarity reference voltage is less than the negative-polarity reference voltage; the first switching circuit comprises a first switching transistor and a second switching transistor; a positive output end of the digital-to-analog converter is connected to a control end of the first switching transistor and a control end of the second switching transistor; a first end of the first switching transistor is connected to receive the first working voltage, a node formed by connecting a second end of the first switching transistor and a first end of the second switching transistor in series is used as the positive-polarity data voltage output end, and a second end of the second switching transistor is connected to receive the positive-polarity reference voltage;

wherein the ghost relieving method comprises:

acquiring input gray scales;

acquiring first gray scales and second gray scales according to the input gray scales;

acquiring corresponding first voltages according to the first gray scales and corresponding second voltages according to the second gray scales by the ghost relieving circuit; and outputting the first voltages and the second voltages respectively through the positive-polarity data voltage output end of the first switching circuit and the negative-polarity data voltage output end of the second switching circuit to a pixel matrix.

2. The ghost relieving method according to claim 1, wherein the step of acquiring first gray scales and second gray scales according to the input gray scales comprises:

establishing a lookup table for sub-pixels at predetermined positions;

determining whether a sub-pixel to be displayed corresponding to one of the input gray scales is the sub-pixel at the predetermined position;

searching the lookup table according to the input gray scale of the sub-pixel to be displayed, and determining the first gray scale and the second gray scale corresponding to the sub-pixel to be displayed, if the sub-pixel to be displayed corresponding to one of the input gray scales is the sub-pixel at the predetermined position;

calculating the first gray scale and the second gray scale corresponding to the sub-pixel to be displayed by using an interpolation algorithm according to the lookup table, if the sub-pixel to be displayed corresponding to one of the input gray scales is not the sub-pixel at the predetermined position.

3. The ghost relieving method according to claim 2, wherein the step of establishing a lookup table for sub-pixels at predetermined positions comprises:

selecting the sub-pixels at the predetermined positions;

determining input gray scales, first gray scales and second gray scales, corresponding to the sub-pixels at the predetermined positions; and storing the input gray scales, the first gray scales, and the second gray scales and thereby forming the lookup table.

4. The ghost relieving method according to claim 1, wherein before the step of acquiring corresponding first voltages according to the first gray scales and corresponding second voltages according to the second gray scales, further comprising:

performing frame rate control according to the first gray scales and the second gray scales.

5. The ghost relieving method according to claim 1, wherein before the step of acquiring corresponding first voltages according to the first gray scales and corresponding second voltages according to the second gray scales, further comprising:

performing dithering according to the first gray scales and the second gray scales.

6. The ghost relieving method according to claim 1, wherein a voltage range from the positive-polarity reference voltage to the first working voltage and a voltage range from the negative-polarity reference voltage to the second working voltage have an overlapped range, the first working voltage is greater than a first voltage corresponding to a highest gray scale of positive-polarity, the negative-polarity reference voltage is greater than a second voltage corresponding to a lowest gray scale of negative-polarity, the positive-polarity reference voltage is less than a third voltage corresponding to a lowest gray scale of positive-polarity, and the second working voltage is less than a fourth voltage corresponding to a highest gray scale of negative-polarity.

7. A ghost relieving method for a display panel comprising a timing controller, a source driver, and a pixel matrix; wherein the timing controller is connected to the source driver; the pixel matrix is connected to the source driver; the source driver comprises a digital-to-analog converter, a first switching circuit, a second switching circuit, and a gamma chip; the gamma chip is connected to the digital-to-analog converter and configured to provide a plurality of reference voltages to the digital-to-analog converter, the digital-to-analog converter is connected to the first switching circuit and the second switching circuit individually, the first switching circuit is connected to receive a first working voltage and a positive-polarity reference voltage and has a positive-polarity data voltage output end, the second switching circuit is connected to receive a second working voltage and a negative-polarity reference voltage and has a negative-polarity data voltage output end, and the positive-polarity reference voltage is less than the negative-polarity reference voltage;

wherein the ghost relieving method comprises:

acquiring input gray scales;

acquiring first gray scales and second gray scales according to the input gray scales by the timing controller;

acquiring first voltages according to the first gray scales and second voltages according to the second gray scales by the source driver; and outputting the first voltages and the second voltages by the source driver through the positive-polarity data voltage output end and the negative-polarity data voltage output end to the pixel matrix;

wherein the timing controller is configured to form a first data line control timing, and a second data line control timing, the first data line control timing and the second data line control timing are formed respectively according to the first gray scale and the second gray scale; the source driver is configured to receive the first data line control timing and the second data line control timing and thereby generate a first data line voltage signal and a second data line voltage signal respectively;

wherein the digital-to-analog converter is configured to receive the first data line control timing and the second data line control timing, the positive-polarity data voltage output end is configured to generate the first data line voltage signal, the negative-polarity data voltage output end is configured to generate the second data line voltage signal, the first data line voltage signal corresponds to the first voltage, and the second data line voltage signal corresponds to the second voltage.

8. The ghost relieving method according to claim 7, wherein a voltage range from the positive-polarity reference voltage to the first working voltage and a voltage range from the negative-polarity reference voltage to the second working voltage have an overlapped range, the first working voltage is greater than a first voltage corresponding to a highest gray scale of positive-polarity, the negative-polarity reference voltage is greater than a second voltage corresponding to a lowest gray scale of negative-polarity, the positive-polarity reference voltage is less than a third voltage corresponding to a lowest gray scale of positive-polarity, and the second working voltage is less than a fourth voltage corresponding to a highest gray scale of negative-polarity.

9. A ghost relieving method for a display panel comprising a ghost relieving circuit, wherein the ghost relieving circuit comprises a digital-to-analog converter, a first switching circuit, a second switching circuit, and a gamma chip; the gamma chip is connected to the digital-to-analog converter and configured to provide a plurality of reference voltages to the digital-to-analog converter, the digital-to-analog converter is individually connected to the first switching circuit and the second switching circuit, the first switching circuit is connected to receive a first working voltage and a positive-polarity reference voltage and has an positive-polarity data voltage output end, the second switching circuit is connected to receive a second working voltage and a negative-polarity reference voltage and has a negative-polarity data voltage output end, and the positive-polarity reference voltage is less than the negative-polarity reference voltage;

wherein the ghost relieving method comprises:

acquiring input gray scales;

acquiring first gray scales and second gray scales according to the input gray scales;

acquiring corresponding first voltages according to the first gray scales and corresponding second voltages according to the second gray scales by the ghost relieving circuit; and outputting the first voltages and the second voltages respectively through the positive-polarity data voltage output end of the first switching circuit and the negative-polarity data voltage output end of the second switching circuit to a pixel matrix;

wherein the second switching circuit comprises a first switching transistor and a second switching transistor; a negative output end of the digital-to-analog converter is connected to a control end of the first switching transistor and a control end of the second switching transistor; a first end of the first switching transistor is connected to receive the negative-polarity reference voltage, a node formed by connecting a second end of the first switching transistor and a first end of the second switching transistor in series is used as the negative-polarity data voltage output end, and a second end of the second switching transistor is connected to receive the second working voltage.

10. The ghost relieving method according to claim 9, wherein a voltage range from the positive-polarity reference voltage to the first working voltage and a voltage range from the negative-polarity reference voltage to the second working voltage have an overlapped range, the first working voltage is greater than a first voltage corresponding to a highest gray scale of positive-polarity, the negative-polarity reference voltage is greater than a second voltage corresponding to a lowest gray scale of negative-polarity, the positive-polarity reference voltage is less than a third voltage corresponding to a lowest gray scale of positive-polarity, and the second working voltage is less than a fourth voltage corresponding to a highest gray scale of negative-polarity.

* * * * *